US006857911B2

(12) United States Patent
Miwa

(10) Patent No.: US 6,857,911 B2
(45) Date of Patent: Feb. 22, 2005

(54) COMMON-USE CONNECTOR FOR MULTIPLE PURPOSE AND METHOD OF MANUFACTURING THE CONNECTOR

(75) Inventor: Takeya Miwa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/101,973

(22) Filed: Mar. 21, 2002

(65) Prior Publication Data

US 2002/0137398 A1 Sep. 26, 2002

(30) Foreign Application Priority Data

Mar. 23, 2001 (JP) ..... 2001-084720

(51) Int. Cl.[7] ..... H01R 13/502
(52) U.S. Cl. ..... 439/701
(58) Field of Search ..... 439/701, 660, 439/715, 712, 709, 350, 752, 686, 374, 590, 567, 608, 908, 620; 361/772

(56) References Cited

U.S. PATENT DOCUMENTS 4,871,320 A * 10/1989 Moussie ..... 439/78
4,900,276 A * 2/1990 Doutrich ..... 439/751
5,415,566 A * 5/1995 Brunker et al. ..... 439/608
5,722,861 A * 3/1998 Wetter ..... 439/701
6,179,659 B1 1/2001 Moden ..... 439/590
6,193,552 B1 2/2001 Chiou et al. ..... 439/607
6,193,563 B1 * 2/2001 Yagi et al. ..... 439/701

* cited by examiner

*Primary Examiner*—Alex Gilman
(74) *Attorney, Agent, or Firm*—Armstrong, Kratz, Quintos, Hanson & Brooks, LLP

(57) ABSTRACT

A terminal or a housing used for a PCB connector and a harness connector is standardized for common use. A PCB connector is structured by a terminal plate 3 provided with an insulating plate body 4 which can be cut at any portion and a terminal 5 placed in the plate body to project both electric contacts 6, 6' of the terminal from front side and rear side of the plate body, and an insulation cover 38 for mounting the terminal plate therein. A harness connector 37 further comprises a terminal receiving block 44', which receives a mating terminal 56, inserted into a rear portion of the cover 38. The terminal receiving block 44' is locked in the cover 38 by locking device 45, 49. A mating connector as same as the terminal receiving block 44' is inserted into a front portion of the cover 38.

8 Claims, 7 Drawing Sheets

COMMON-USE CONNECTOR FOR MULTIPLE PURPOSE AND METHOD OF MANUFACTURING THE CONNECTOR

BACKGROUND OF THE INVENTION

1. Field of the Invention

This invention relates to a common-use connector for multiple purpose, which can connect wire harnesses mutually or connect with a circuit board by using a terminal, a connector housing or a part of the connector housing for common use, and manufacturing method for the connector.

2. Description of the Related Art

An example of a harness connector (wire-to-wire connector) by prior art, for connecting wire harnesses mutually, is shown in FIG. 10. A PCB connector by prior art for connecting with a circuit board is shown in FIG. 13.

A harness connector 60 shown in FIG. 10 is provided with a female connector housing 62 with a spacer 63 shown in FIG. 11 and a male terminal 64 shown in FIG. 12. The spacer 63 and the connector housing 62 are formed by molding with a synthetic resin. The spacer 63 is for locking the terminal 64 in the connector housing 62 so as not to come out rearwardly as shown in FIG. 10.

The connector housing 62, as shown in FIG. 11, is provided, in a front half area thereof, with a connector receiving section 65 having a terminal inserting hole 66 in a bottom wall (a base wall) thereof and, in a rear half area, with a terminal receiving section 67 continuous to the terminal inserting hole 66. A connector housing having the connector receiving section 65 is called the female connector housing 62 and a connector housing inserted into the connector receiving section 65 is called the male connector housing herein. The connector housing 62 is provided with a spacer inserting hole 68 perpendicular to direction of terminal insertion and communicating with the terminal receiving section 67. The spacer 63 is formed into L-shape and is held temporarily to be stuck partially out of an outside wall of the terminal receiving portion 69. In this condition, the male terminal 64 with an electric wire (FIG. 10) is inserted into the terminal receiving section 67 and the terminal 64 is locked by pushing the spacer 63 into the terminal receiving portion 69.

The male terminal 64 shown in FIG. 12 is formed by punching and bending conductive metal sheet, such as copper alloy or aluminum alloy, and is provided in a front half area with tab shape electric contact 70, in a middle area with a box shape portion 71 for locking and in a rear half area with a couple of crimp contact pieces 72 in front and in the rear for electric wire connecting portion.

The tab shape electric contact 70 of the terminal 64, which is inserted into the connector housing 62 as shown in FIG. 10, projects into the connector receiving section 65. A box shape portion 71 in the middle of the terminal is locked at a rear step portion by the spacer 63. In general, the terminal 64 is primarily locked at the other opening thereof by a flexible lance shape locking (not shown) in the terminal receiving section 69 other than the spacer 63.

The PCB connector 61 shown in FIG. 13 is provided with a female connector housing 73 made of a synthetic resin and a male terminal 75 inserted to penetrate a rear portion of the connector housing 73.

The connector housing 73, as shown in FIG. 14, is formed at a front half thereof with a connector receiving portion 76 and at a rear half thereof with a terminal holding portion 77 having a terminal inserting hole 79*a* communicated to a connector receiving section 78. A terminal 75, as shown in FIG. 15, is formed at a front half thereof with a tab shape electric contact 79, at a rear half thereof with a PCB connecting portion 80 and at left and right side of a middle thereof with a pair of stopper projections 81. The terminal 75 is made to punch conductive metal sheet.

The terminal 75, as shown in FIG. 13, is pressed for fitting into the terminal inserting hole 79*a* from rear side or front side of the connector housing 73. The stopper projection 81 prevents that the terminal comes out from the connector housing. The PCB connector 61 is mounted perpendicularly on a circuit board 82. The PCB connecting portion 80, which is the rear half portion of the terminal 75, is inserted through the circuit board 82 and is soldered with a printed circuit (not shown) on a rear surface of the circuit board 82. The mating male connector (not shown) is connected with a wire harness.

Objects to be Solved

The terminal 64 of the harness connector 60 and the terminal 75 of the PCB connector 61, as mentioned above, have different shape of each. Therefore, the harness connector 60 and the PCB connector 61 by prior art require two different terminals and two different forming tools for respective terminals to be costly and be troublesome on managing the terminals and tools.

Tolling dies to mold mating male connector housings corresponding to the female harness connector housing 62 and the female PCB connector housing 73 are also required. Totally a lot of tooling dies including respective male and female connector housings are required to be costly and be troublesome of the management.

The connector housing 62 of the harness connector 60 and the connector housing 73 of the PCB connector 61 have different shape to be costly and be troublesome of the management, as same as mentioned above.

As an example by prior art, one tooling die for a terminal 64 of a harness connector 60, one for a terminal 75 of a PCB connector 61, ten for a connector housing 62 and a spacer 63 of the harness connector 60, five for a connector housing 73 of the PCB connector 61 and ten for a connector housing and a spacer of a mating male connector (not shown), i.e. total twenty eight tooling dies, are required.

To overcome the above drawback, one object of this invention is to provide a common-use connector for multiple purpose and manufacturing method for the connector which can reduce number of kinds of terminals and/or connector housings regarding a harness connector and a PCB connector to reduce costs of tooling dies and management thereof.

SUMMARY OF THE INVENTION

How to Attain the Object

In order to attain the objects, a common-use connector for multiple purpose comprises a terminal plate including an insulating plate body which can be cut at any portion and terminals placed in the plate body to project both electric contacts of the terminal from front side and rear side of the plate body, and an insulation cover for mounting the terminal plate at the inside thereof, to perform as a PCB connector.

Thereby, number of the terminals of the terminal plate can be adjusted by cutting the plate body correspondingly to the number of the terminals so that the adjusted terminal plate can be used in any of the PCB connectors or the harness connectors. As a PCB connector, an electric contact of one end of the terminal is connected with a circuit board and an electric contact of the other end of the terminal is connected with a mating connector. A cover works as a female connector housing.

The common-use connector for multiple purpose comprises the common-use connector for multiple purpose as mentioned above and the cover is provided with a locking arm and a stopper for holding a circuit board between the locking arm and the stopper. The connector performs as a PCB connector.

Thereby, the connector can be fixed easily on a circuit board to be clamped between the locking arm and the stopper of the cover with one operation.

A common-use connector for multiple purpose comprises a terminal plate provided with an insulating plate body which can be cut at any portion and a terminal placed in the plate body to project both electric contacts of the terminal from front side and rear side of the plate body, an insulation cover for mounting the terminal plate at the inside thereof, and a terminal receiving block, which is integrated into a rear portion of the cover, for receiving a mating terminal corresponding to a rear side electric contact, to perform as a harness connector.

As a harness connector, the terminal receiving block is integrated to a rear portion of the cover to connect the electric contact of one end of the terminal in the terminal plate with a terminal in the terminal receiving block so that the electric contact of the other end of the terminal can be connected with a mating connector.

Advantageously, a common-use connector for multiple purpose is built as a harness connector by integrating the terminal receiving block having a mating terminal with a rear portion of the cover.

Integrating the terminal receiving block with a rear portion of the cover in above structure, the electric contact of one end of the terminal in the terminal plate is connected with the terminal in the terminal receiving block and the electric contact of the other end of the terminal can be connected with a mating connector. Thus, the PCB connector and the harness connector can be formed by using one type of a cover as a common part.

The common-use connector for multiple purpose, as mentioned above, further comprises a locking device for locking the terminal receiving block in the cover.

Thereby, the terminal receiving block can be fixed easily in the cover with one operation by the locking device.

In the common-use connector for multiple purpose, as mentioned above, the cover is formed in a front portion thereof to receive the same terminal receiving block as a mating connector.

Thereby, the terminal receiving block and the mating connector can be used as a common part so that the terminal receiving block or the terminal therein can be standardized as one type. The mating connector is inserted into the front area of the cover to connect with the electric contact of the other end of the terminal in the terminal plate.

Advantageously, the common-use connector for multiple purpose, as mentioned above, further comprises a locking device in the cover for locking the terminal plate in the cover.

Thereby, the terminal plate can be fixed easily in the cover with one operation by the locking device.

A method of manufacturing a common-use connector for multiple purpose comprises steps of placing a plurality of terminals juxtapositionaly through an insulating long-sidewise plate body, cutting the plate body to have required number of terminals, inserting the cut plate body into an insulation cover to project both electric contacts of the terminal front-to-rear in the cover and to enable an electric contact of one end of the terminal for connecting with a circuit board as a PCB connector.

Thus, number of the terminals of the terminal plate can be adjusted by cutting the plate body correspondingly to the number of the terminals so that the adjusted terminal plate can be used in any of the PCB connectors or the harness connectors. As a PCB connector, an electric contact of one end of the terminal is connected with a circuit board and an electric contact of the other end of the terminal is connected with a mating connector. A cover works as a female connector housing.

The other method of manufacturing a common-use connector for multiple purpose, comprises steps of placing a plurality of terminals juxtapositionaly through an insulating long-sidewise plate body, cutting the plate body to have required number of terminals, inserting the cut plate body into an insulation cover to project both electric contacts of the terminal front-to-rear in the cover, inserting a connecting terminal corresponding to an electric contact of one end of the terminal into a body of a terminal receiving block, and integrating the terminal receiving block with a rear portion of the cover for connecting the connecting terminal with the electric contact of one end of the terminal as a harness connector.

As a harness connector, the terminal receiving block is integrated to a rear portion of the cover to connect the electric contact of one end of the terminal in the terminal plate with a terminal in the terminal receiving block so that the electric contact of the other end of the terminal can be connected with a mating connector.

Advantageously, the method of manufacturing a common-use connector for multiple purpose, as mentioned above, comprises further steps of inserting a connecting terminal corresponding to an electric contact of one end of the terminal into a body of a terminal receiving block, and integrating the terminal receiving block with a rear portion of the cover for connecting the connecting terminal with the electric contact of one end of the terminal as a harness connector.

Thus, integrating the terminal receiving block with the rear portion of the cover, the electric contact of one end of the terminal in the terminal plate is connected with the terminal in the terminal receiving block and the electric contact of the other end of the terminal can be connected with a mating connector. Therefore, the PCB connector and the harness connector can be formed by using one type of a cover as a common part.

Advantageously, the method of manufacturing a common-use connector for multiple purpose, as mentioned above, comprises further step of using the same terminal receiving block as a connector for a mating connector to be connected with the electric contact of the other end of the terminal.

Thereby, the terminal receiving block and the mating connector can be used as a common part so that the terminal receiving block or the terminal therein can be standardized as one type. The mating connector is inserted into the front area of the cover to connect with the electric contact of the other end of the terminal in the terminal plate.

The above and other objects and features of this invention will become more apparent from the following description taken in conjunction with the accompanying drawings.

DESCRIPTION OF THE PREFERRED EMBODIMENT

Figure 1:
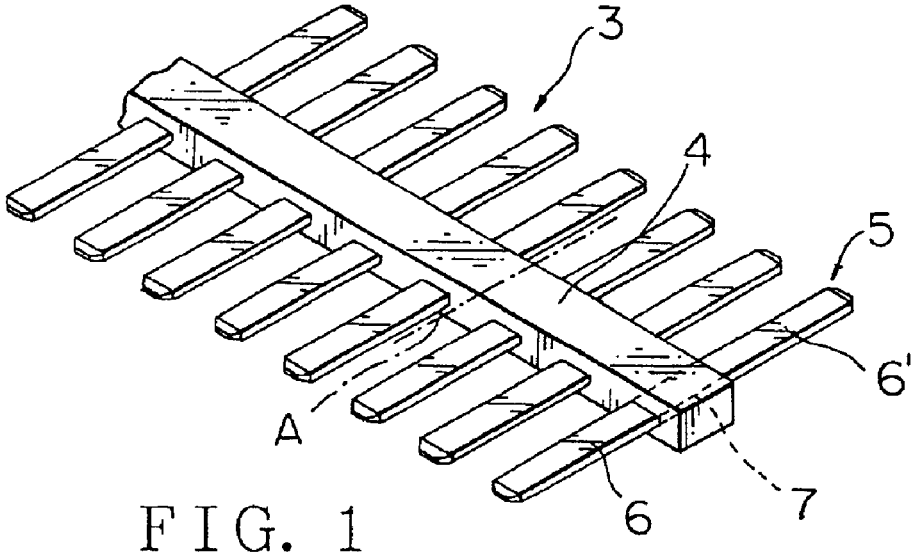
FIG. 1 is a perspective view of a terminal plate before cutting of one embodiment of a common-use connector for multiple purpose according to the invention.
Figure 5:
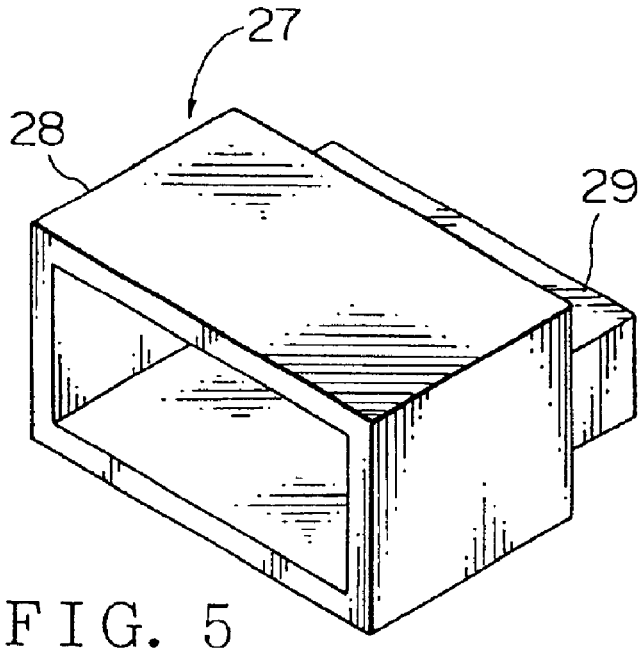
FIG. 5 is a perspective view, showing a cover of a PCB connector as a common-use connector for multiple purpose.
Figure 6:
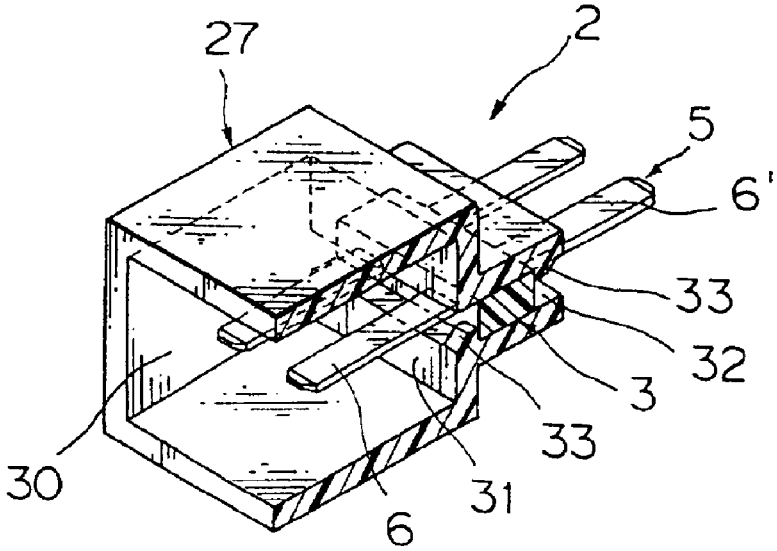
FIG. 6 is a sectional perspective view of the PCB connector.

An embodiment according to this invention will now be described with reference to drawings. FIGS. 1–4 show an embodiment of a harness connector and manufacturing method thereof as a common-use connector for multiple purpose, according to this invention. FIGS. 1, 5 and 6 show an embodiment of a PCB connector and manufacturing method thereof as a common-use connector for multiple purpose, according to this invention.

The terminal plate 3 as a common part, shown in FIG. 1, to be cut in required length is used in the harness connector 1 (FIG. 4) or the PCB connector 2 (FIG. 6). The terminal plate 3 is provided with a synthetic-resin-made insulating long-sidewise plate body 4 and a male terminal 5 fixed in the plate body 4 therethrough to be extended forwardly and rearwardly from the plate body 4.

The male terminal 5 is formed into straight tab shape or pin shape having tab shape or pin shape electric contacts 6, 6' at the front and rear area of the terminal. The terminal 5 is fixed at a middle portion 7 thereof in the plate body 4 by insert molding or press fitting. The middle portions 7 of adjacent respective terminals 5 may be joined to each other by a connecting piece (not shown). The plate body 4 may be cut between adjacent respective terminals 5, such as a portion shown by a chain line A. V-shape cut-off (not shown) can be provided at the portion for cutting easily. The terminals 5 are located juxtapositionaly with a constant spacing.

Figure 2:
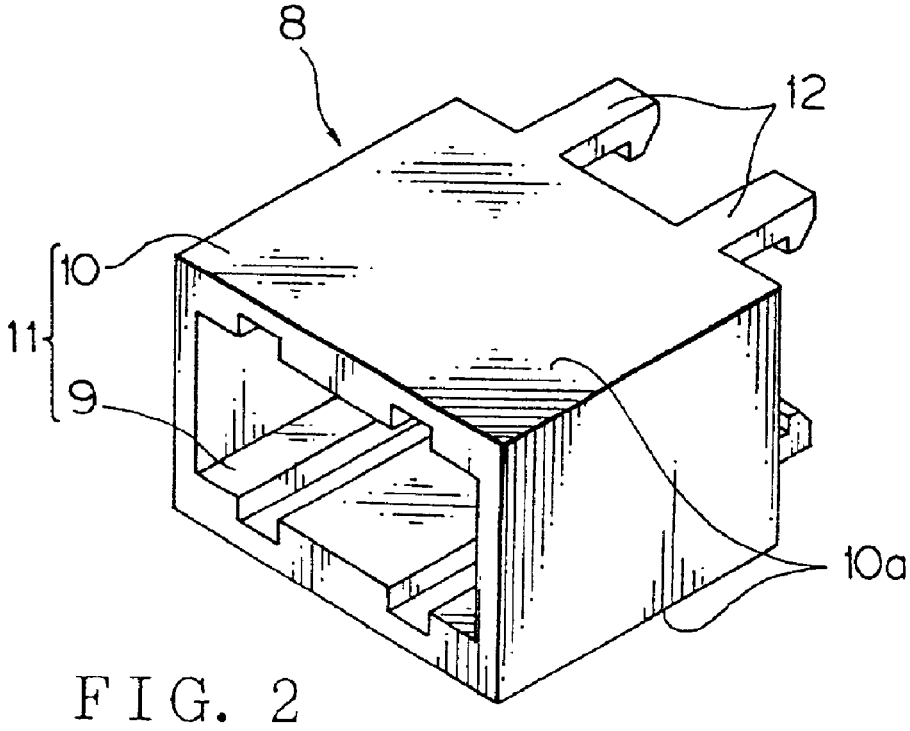
FIG. 2 is a perspective view of a cover for a harness connector as a common-use connector for multiple purpose.
Figure 4:
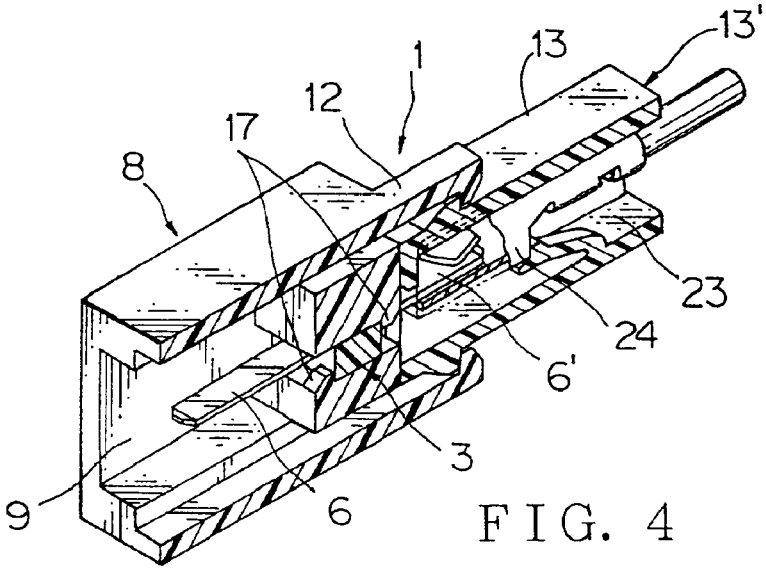
FIG. 4 is a sectional perspective view, showing a harness connector.

FIG. 2 shows a cover 8, i.e. a connector receiving portion, which is a part of a synthetic-resin-made female connector housing to be used for the harness connector 1 (FIG. 4). The cover is provided inside thereof with a connector receiving section 9 therethrough in front and rear direction (direction of inserting and extracting a connector). A connector receiving portion 11 is formed with the connector receiving section 9 and surrounding walls 10. Right and left pair of locking arms 12 (locking device) are provided projecting rearwardly from rear ends of top and bottom walls 10*a* of the connector receiving portion 11.

Figure 13:
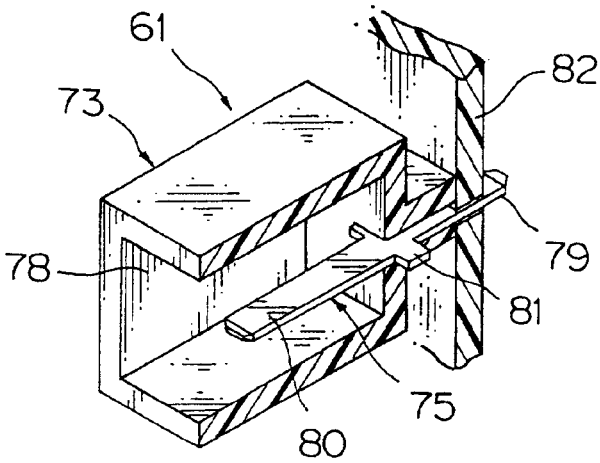
PRIOR ART FIG. 13
FIG. 13 is a sectional perspective view of a PCB connector by prior art.
Figure 14:
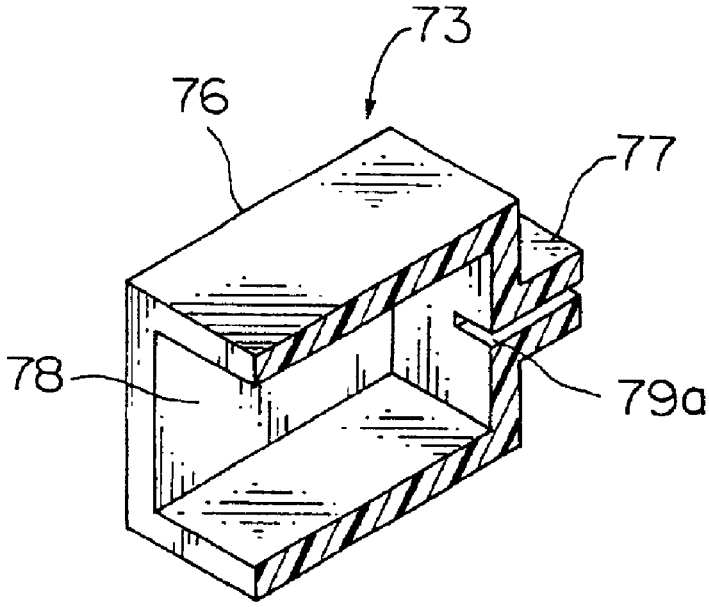
PRIOR ART FIG. 14
FIG. 14 is a sectional perspective view of a connector housing by prior art.
Figure 15:
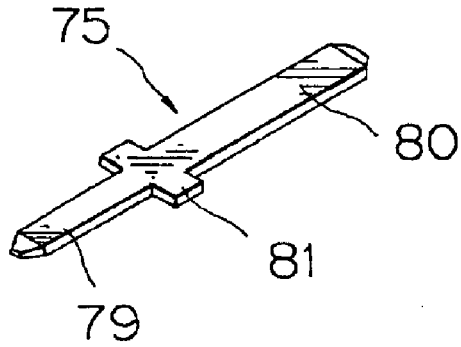
PRIOR ART FIG. 15
FIG. 15 is a perspective view of a terminal by prior art.

A synthetic-resin-made terminal receiving block body 13, which is a part of the connector housing, is integrally locked in the cover 8, i.e. the connector receiving portion, by the locking arm 12, as shown in FIG. 13. Thus, the female connector housing is built by several parts of the cover 8 and the terminal receiving block body 13. The locking arm 12, provided at an end thereof with an inward locking projection 15, has flexibility of upward and downward direction. The locking projection 15 has a slant slide surface 15*a* at an external end and a vertical locking surface 15*b* at an inner end.

Figure 3:
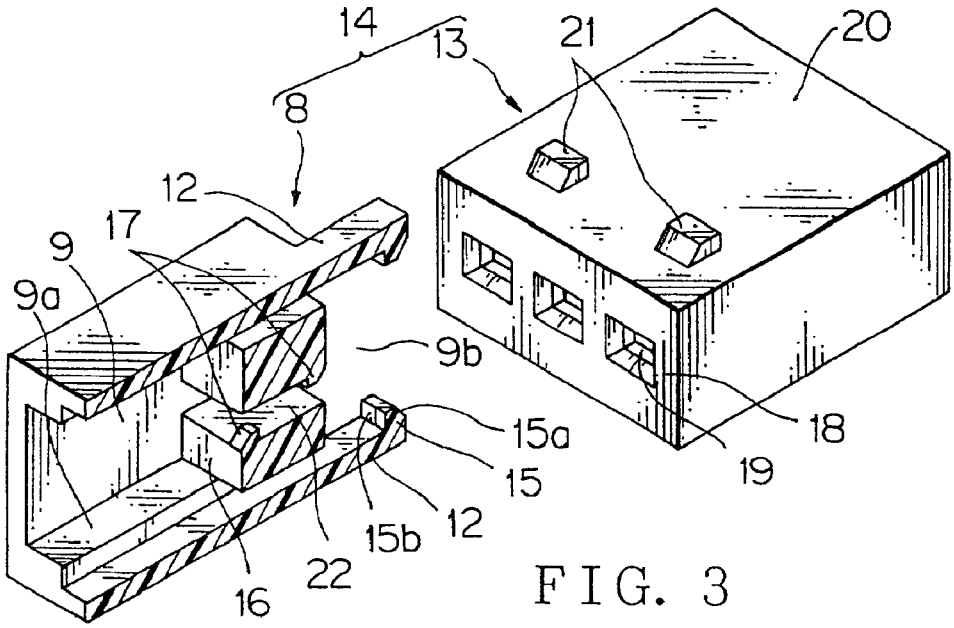
FIG. 3 is a partially sectional exploded perspective view, showing a condition before inserting a terminal receiving block into the cover.

A locking projection 17, as shown in FIG. 3, is provided on upper or down inner wall 16 on a bottom portion of the connector receiving section 9 of the cover 8 for fixing the terminal plate 3 (FIG. 1). The locking projections 17 are located alternately at front and rear ends of the inner wall to clamp the terminal plate 3 in direction of the thickness between front and rear locking projections 17. The terminal plate 3, which is cut in required length, is fixed in the cover 8. The front locking projection 17 has a slant slide surface at a front end and a vertical locking surface at a rear end. The rear locking projection 17 has a slant slide surface at a rear end and a vertical locking surface at a front end. Number of the locking projection 17 can be adjusted. The terminal plate 3 is locked without looseness by the locking projection 17 to be inserted from a front side or a rear side of the cover 8 into a rear portion (inmost side) of the connector receiving portion 9.

The terminal receiving block body 13, shown in FIG. 3, is formed into rectangular block smaller in width and height than the cover 8. The terminal receiving block body 13 is provided on a front wall 18 with a terminal inserting hole 19 and on each of top and bottom walls 20 with a pair of engaging projections 21 (locking device) corresponding to the locking projection 15. Locking concave portions (not shown) as locking device instead of the engaging projections 21 can be provided. The engaging projection 21 has a slant slide surface at a front end and a vertical engaging surface at a rear end. The terminal receiving block 13 is formed slightly smaller in horizontal dimension (width) and in vertical dimension (height) than the width and the height of a rear portion in the connector receiving section 9 of the cover 8.

Preferably, in the connector receiving section 9 of the cover 8, a terminal plate mounting portion 22 may be formed only small correspondingly to the terminal plate 3 and a front receiving section 9*a* may be formed larger than the terminal plate 3 correspondingly to a mating male connector (not shown) and a rear receiving section 9*b* may be formed larger than the terminal plate 3 correspondingly to the terminal receiving block body 13. The height of the terminal plate 3 can be larger to make the height of the terminal plate mounting portion 22 the same as respective receiving sections 9*a*, 9*b* of the cover 8. The terminal receiving block body 13 can be fixed only by the locking arm 12 without the rear receiving section 9*b*.

A female terminal 24, as shown in FIG. 4, is inserted into the terminal receiving block body to build a terminal receiving block 13'. The terminal receiving block 13' is moved from a rear side of the cover 8 to bend the locking arm 12 outwardly and is inserted from a rear opening of the cover 8 into the cover 8. In FIG. 4, there is a small gap between a front end of the terminal receiving block body 13 and a rear end of the terminal plate 3. The terminal receiving block body 13 may be provided at the front end thereof with a cutoff (not shown) for escaping the locking projection 17 to abut the front end of the terminal receiving block body 13 on the rear end of the terminal plate 3.

While a front area of the terminal receiving block body 13 is being inserted into the rear receiving section 9*b* of the cover 8, the engaging projection 21 of the terminal receiving block body 13 is sliding on the locking projection 15 of the locking arm 12 to bend the locking arm 12 outwardly and the locking projection 15 is engaged with a rear end of the engaging projection 21 when the locking arm 12 is returned. When the locking concave portion (not shown) is provided instead of the engaging projection 21, the terminal receiving block body 13 is inserted to bend the locking arm 12 at the front end thereof and the locking projection 15 is engaged with the locking concave portion (not shown) when the locking arm 12 is returned. Simultaneously, a tab shape or pin shape rear electric contact 6' of the terminal plate 3 is inserted from the terminal inserting hole 19 (FIG. 3) of the front end of the terminal receiving block body 13 into the terminal receiving block 13'.

The terminal receiving block body 13 is provided, inside thereof, with a terminal receiving section 23 and a lance shape flexible terminal locking piece (not shown) in the terminal receiving section 23. A secondary terminal locking spacer (not shown) as same as prior art can be used instead of the lance shape locking piece or together with. A female terminal 24 with an electric wire is received in the terminal receiving section 23. The female terminal 24 has a box shape or barrel shape electric contact at a front area and an electric connecting portion, which is provided with each pair of crimp pieces in front and rear, at a rear area. The electric contact of the female terminal 24 has a resilient contact piece (not shown) inside.

After the terminal receiving block body 13 is integrated with the cover 8, the female terminal 24 may be inserted into the terminal receiving block body 13 or the terminal receiving block 13', in which the female terminal 24 is inserted, may also be integrated with the cover 8. When the female terminal 24 is inserted, the female terminal 24 can be inserted efficiently for respective kinds of the connector 1 at once. When the terminal receiving block 13' is integrated, the female terminal 24 can be inserted efficiently into a plurality of the same terminal receiving block bodies 13.

One terminal receiving block body 13 is provided inside thereof with at least one terminal receiving section 23 and, in many cases, juxtapositionaly with a plurality of terminal receiving sections 23. The tab shape or pin shape electric contact 6' of the terminal plate 3 (FIG. 1) is inserted into the box shape or barrel shape electric contact of the female terminal 24 (FIG. 4) and contacted elastically therewith. The terminal plate 3 can be piled correspondingly to vertically stacked terminal receiving sections 23 in the terminal receiving block body 13.

The terminal receiving block 13' can be used for common use as a mating male connector corresponding to the connector receiving section 9 of the cover 8. Therefore, different mating male connector is not required so that another tooling dies therefor are unnecessary. An inner wall of the cover 8 may have a guide groove (not shown) for guiding and escaping the engaging projection 21 of the terminal receiving block body 13 (FIG. 13) so that interference of the engaging projection 21 and the cover 8 can be prevented and also inserting a connector can be done smoothly without sticking motion. If the engaging concave portion is provided instead of the engaging projection 21, the guide groove (not shown) for escaping is not required.

FIGS. 1, 5 and 6 show process procedure of an embodiment of manufacturing method of a PCB connector according to this invention.

The terminal plate, which is cut in required length at a chain line A as shown in FIG. 1, is inserted into a synthetic-resin-made cover 27 (FIG. 5) so that a PCB connector 2 is built up easily.

The cover 27 shown in FIG. 5 is to form integrally a terminal plate receiving portion 29 (terminal plate mounting portion) on a rear area of a connector receiving portion 28 and is similar to the cover 8 of the harness connector 1 (FIG. 3) in which the locking arm 12 is removed. The cover 27 performs as a connector housing. The terminal plate mounting portion 29 in FIG. 5 is formed smaller in width and height than the connector receiving portion 28 correspondingly to the terminal plate 3 (FIG. 1).

The cover 27 is provided with a connector receiving section 30 contiguous to a rear narrow terminal plate receiving section 32 through a step portion 31. A locking projection 33 (locking device) for the terminal plate 3 is provided on top or bottom inner wall of the terminal plate receiving section 32. The locking projection 33 has a similar shape as mentioned above about the cover 8 (FIG. 3) of the harness connector 1.

The terminal plate 3, which is cut in required length, is inserted from front side or rear side of the cover 27 into the terminal plate mounting portion 29. Operation of inserting the terminal plate 3 from rear side of the cover 27 is easier as same as the harness connector 1. The top end of the rear electric contact 6' of the male terminal 5 in the terminal plate 3 projects to outside of the cover 27 from a rear opening of the cover 27 and the front electric contact 6 of the terminal 5 projects into the connector receiving section 30.

The terminal plate mounting portion 29 of the cover 27 is placed vertically on a circuit board (not shown) and the rear electric contact 6' of the terminal 5 is connected through the circuit board with a printed circuit on a rear side of the circuit board by soldering. In this condition, a mating male connector (not shown) is inserted into the connector receiving section 30 and an electric contact of a female terminal in the male connector is contacted elastically with the front electric contact 6 of the terminal 5.

The harness connector 1, shown in FIG. 4, and the PCB connector 2, shown in FIG. 6, have different shape of the cover 8 and 27. However, the terminal plate 3 can be used as a common part therein so that tooling dies for a terminal can be standardized as one type and then cost of production and management including tooling cost is reduced. Furthermore, the terminal receiving block 13 can be used for common use as a mating male connector corresponding to respective connectors 1, 2 of FIGS. 4 and 6 so that cost of production and management including tooling cost is reduced.

As an example, one common tooling die for a male terminal 5 of a harness connector 1 and a PCB connector, one for a female terminal 24 of a terminal receiving block 13, five for a cover 8 of the harness connector 1, five for a cover 27 of the PCB connector 2 and ten for the terminal receiving block 13 and a spacer therefor (not shown), i.e. total only twenty two tooling dies, are required so that six tooling dies is reduced against twenty eight tooling dies by prior art. This is a case of five tooling dies for each cover 8 or 27. When number of tooling dies for each cover 8 or 27 is ten, eleven tooling dies can be reduced against a case by prior art.

Figure 7:
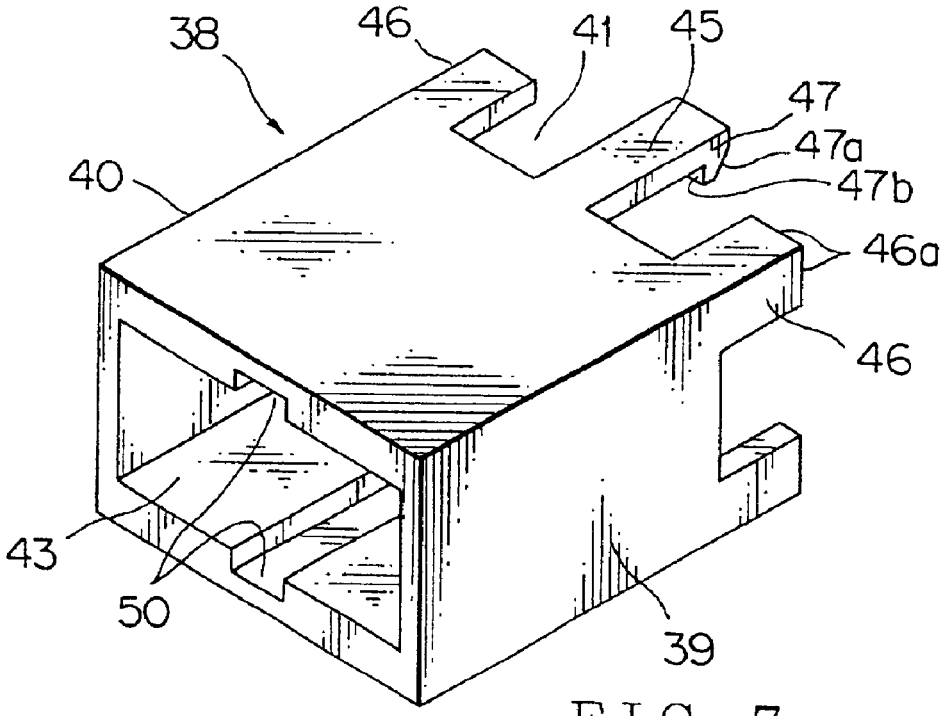
FIG. 7 is a perspective view of a cover of the other embodiment of a common-use connector for multiple purpose according to this invention.
Figure 8:
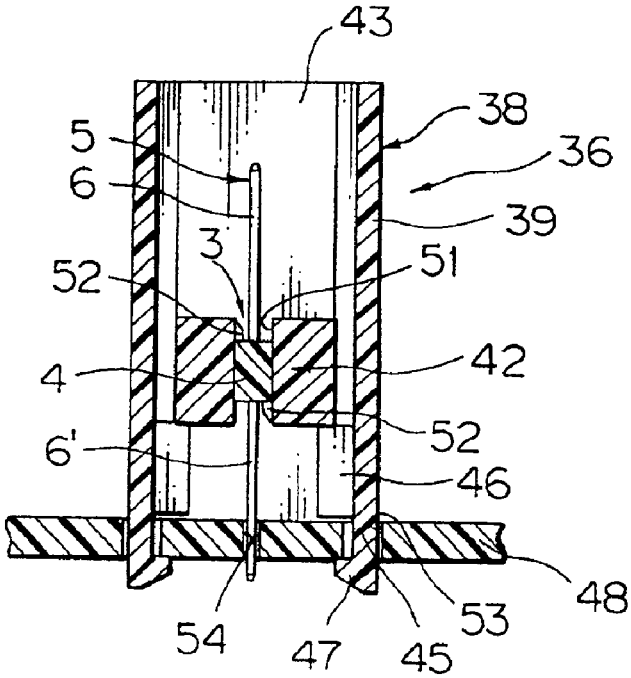
FIG. 8 is a sectional view of a PCB connector with the cover.
Figure 9:
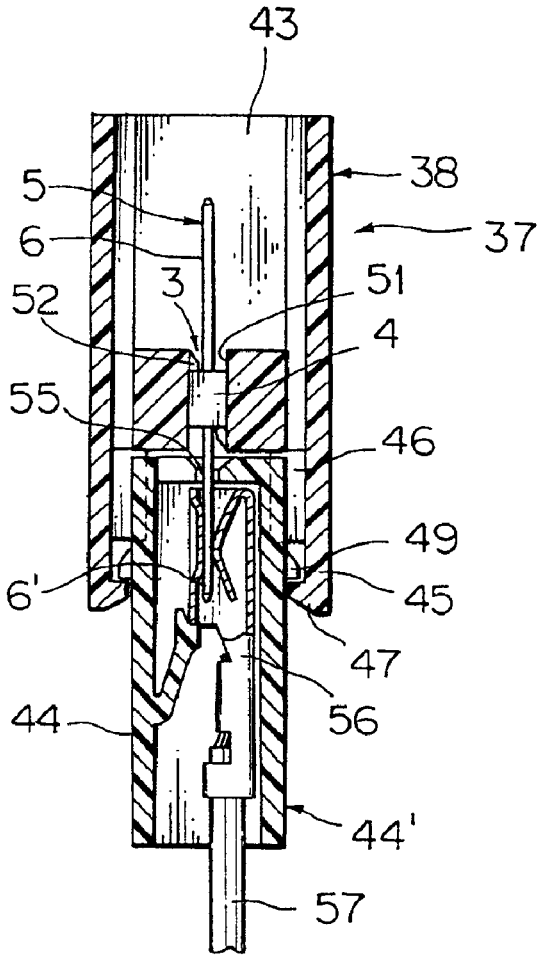
FIG. 9 is a sectional view of a harness connector with the cover.
Figure 10:
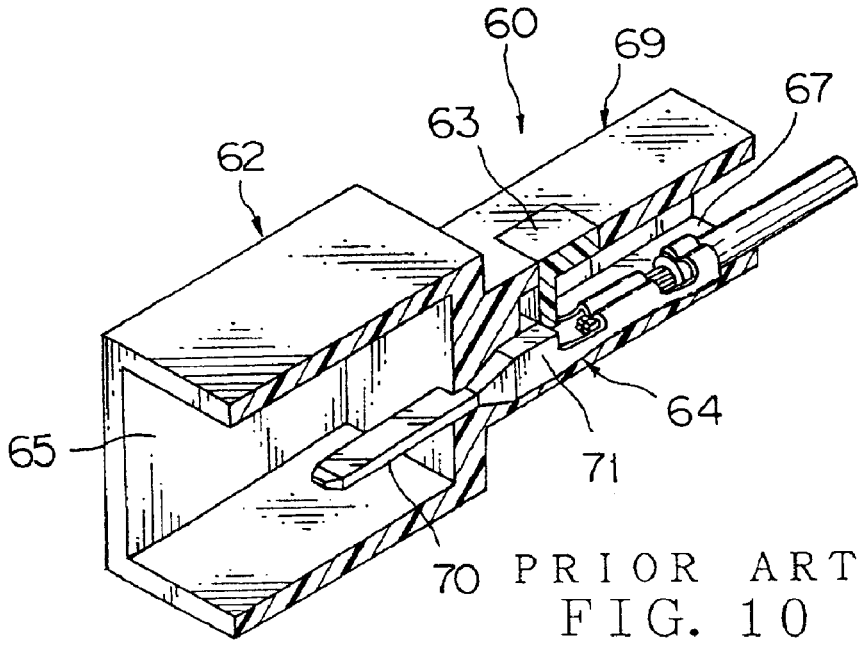
PRIOR ART FIG. 10
FIG. 10 is a sectional perspective view of a harness connector by prior art.
Figure 11:
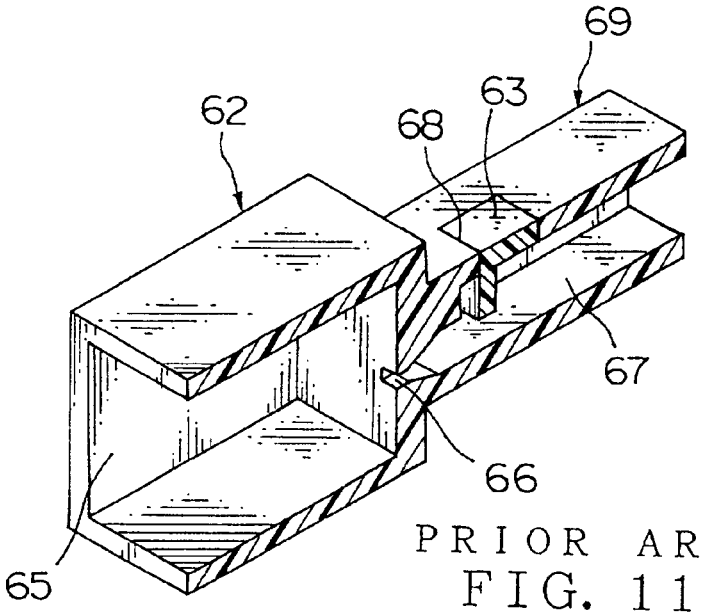
PRIOR ART FIG. 11
FIG. 11 is a sectional perspective view of a connector housing by prior art.
Figure 12:
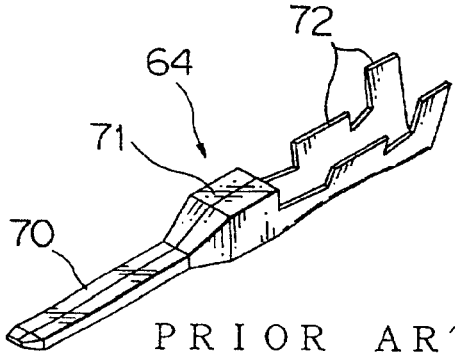
PRIOR ART FIG. 12
FIG. 12 is a perspective view of a terminal by prior art.

FIGS. 7, 8 and 9 show the other embodiment of manufacturing method of a common-use connector for multiple purpose according to this invention.

This connector includes a terminal plate 3 shown in FIG. 1 as a common part and a cover 38 as a common part for a connector housing of a PCB connector 36 (FIG. 8) and a cover of a harness connector 37.

The synthetic-resin-made cover 38, for common use as shown in FIG. 7, is formed into rectangular tube shape with a surround, i.e. top, bottom, right and left, walls 39, front and rear connector receiving portions 40, 41 contiguous to each other, and a terminal plate mounting portion 42 (FIG. 8) in the middle area of the cover 38. Top, bottom, right and left are tentative defined herein and may be changed by mounting direction of the connector. Front is connecting direction of the connector and rear is removing direction of the connector.

The front connector receiving portion 40 has a connector receiving section 43, which has the same width and height as an inner space of the rear connector receiving section 41 (not room), to connect the same terminal receiving block 44' (FIG. 9), i.e. a male connector, into each connector receiving portion 40, 41. Respective connector receiving portions 40, 41 can be formed to connect with different male connectors 44' for each.

The cover 38 is formed integrally, at each rear end of top and bottom walls with a flexible locking arm 45 (locking device) projecting rearwardly and at each of four corners of rear end thereof with a stopper wall or a stopper projection 46 (stopping portion) projecting rearwardly and shorter than the locking arm 45. The locking arm 45 has an inward locking projection 47 which is provided with a slant slide surface 47*a* at rear end and a vertical locking surface 47*b* at front end, similarly as the embodiment shown in FIG. 4. The stopping wall 46 is formed into L-shape in vertical section with a vertical stopping surface 46*a* at rear end. Horizontal distance along front-rear direction between the stopping surface 46*a* and the locking projection 47 of the locking arm 45 is slightly larger than the thickness of the circuit board 48 as shown in FIG. 8.

The cover 38, shown in FIG. 7, is formed in the center of an each inner surface of top and bottom walls with a guide groove 50, to guide smoothly an engaging projection 49 (locking device, FIG. 9) of a mating male connector, same as the connector 44' in FIG. 9. A flexible locking arm (not shown) with a locking projection corresponding to the engaging projection 49 of the mating male connector 44' can be formed integrally on the top wall and/or the bottom wall of the cover 38. Large rectangular gaps are formed between respective stopping walls 46 and between the stopping wall 46 and the locking arm 45.

A pair of base walls 51 is formed in the middle area of the cover 38, contiguously to each foot of the locking arms 45 and the stopping walls 46, projecting from inside of the wall 39, symmetrically in the vertical plane to connecting direction, integrally with the cover 38. Locking projections 52 (locking device) for the terminal plate 3 are provided alternately at front end and rear end on the facing surfaces of respective base walls 51. Thus, the terminal mounting portion 42 is structured. The insulating-resin-made terminal plate body 4 of the terminal plate 3 is clamped in direction of the thickness of the plate body 4 between respective locking projections 52. The terminal plate mounting portion 42 including the locking projections 52 is the same as the embodiment shown in FIG. 3. The tab shape electric contacts 6, 6' of the male terminal 5 project in the same length forwardly and rearwardly from the terminal plate 3. One electric contact 6 is located in the connector receiving section 43 and the top end of the other electric contact 61 is located between the top ends of the stopping wall 46 and the locking arm 45.

A circuit board 48 is fixed between the stopping walls 46 and the engaging projections 47 of the locking arms 45 of the cover 38 in which the terminal plate 3 is mounted. As an example, the circuit board is provided with a arm inserting hole 53 and a terminal inserting hole 54. While a pair of the locking arm 45 is being inserted into the respective arm inserting holes 53, the locking arms 45 with claw-shape locking projection 47 is bent and, when the locking projections 47 go through the inserting holes 53, the locking arms 45 return to lock the circuit board 48 and the electric contact 6' of the terminal 5 is also inserted into the terminal inserting hole 54. Rear surface of the circuit board 48 abuts on the locking surface of the locking projection 47 and front surface of the circuit board 48 abuts on the stopping surfaces 46*a* of top ends of the stopping walls 46. Thus, the PCB connector 36 is fixed securely and easily on the circuit board 48. Fixing with screws the PCB connector 36 on the circuit board 48 according to prior art is not required so that parts cost and operation cost are reduced.

The circuit board 48, without the arm inserting holes 53, which has almost same width of inner distance between the locking arms 45 can be used. The top end of the electric contact 6' of the terminal 5 is connected with a circuit (not shown) on the rear side of the circuit board 48. The circuit may be not only a printed circuit but also a circuit by bus bars. Connecting may be done not only by soldering but also by spring contacting with a female terminal (not shown) of the bus bars.

FIG. 9 shows a harness connector 37 structured by using the same cover 38 in FIG. 8. Main portion in FIG. 9 is almost same as main portion in FIG. 4. The terminal receiving block 44' as a male connector is inserted into a bottom portion of the cover 38 and fixed by the locking arms 45.

The stopping walls 46 can be used as guiding walls for inserting the terminal receiving block 44' to increase a wall thickness of the stopping walls. In such a case, the terminal receiving block 44' is guided into the bottom portion of the cover 38 with no positioning error by the stopping walls 46 and the terminal receiving block body 44 as a connector housing is held securely at outside surface thereof by inside surface of the stopping walls 46.

Engaging projections 49 of the terminal receiving block body 44 are going into inside between the locking arms 45 to bend the locking arms 45 outwardly and engaging surfaces of the engaging projections 49 abut on locking surfaces of the locking projections 47 of the returned locking arms 45. And a front end of the terminal receiving block body 44 abuts on rear surfaces of the base walls 51 in the middle of the cover 38. Thus, the terminal receiving block 44 is fixed securely without looseness in the bottom portion of the cover 38.

The rear electric contact 6' of the terminal 5 in the terminal plate 3 is inserted from the terminal inserting hole 55 on the front wall of the terminal receiving block 44 into the electric contact of the female terminal 56 in the block 44 to contact with spring contact piece in the electric contact. The female terminal 56 is locked by a lance-shape locking piece in the terminal receiving block 44 or the secondary locking spacer (not shown) and joined with an electric wire 57 by crimp contact. Number of the terminal 56 can be adjusted for a circuit. The male connector 44 as same as the terminal receiving block 44 is inserted into the front connector receiving section 43 of the cover 38. Thereby, the terminal receiving block 44 and the male connector 44 can be used for common use. According to the embodiment in FIGS. 7, 8 and 9, the terminal plate 3, the cover 38 of the PCB connector 36 and the cover 38 of the harness connector 37 can be used for common use.

While the forms of the invention herein disclosed constitute presently preferred embodiments, many others are possible. It is not intended herein to mention all the possible embodiments of the invention which will be apparent to those skilled in the art. It is understood that the term used herein are merely descriptive rather than limiting, in that various changes may be made without departing from the spirit or scope of this invention as defined by the following claims.

What is claimed is:

1. A kit of components for multiple purposes, comprising:

a terminal plate having an easy-cut insulating plate body with terminals, electric contacts of the terminals projecting from front-to-rear of the plate body; both front and rear projecting terminals being one standard type equally spaced, and all the same length, the terminal plate being lockable in either a harness connector or a PCB connector thereby having multi purposes, and the front and rear and left and right side halves of the terminal plate being symmetrical;

a first insulation cover for the harness connector;

a terminal receiving block; and a second insulation cover for the PCB connector.

2. The kit of components for multiple purposes according to claim 1, wherein both of the first and second insulation covers include a locking projection and a stopping portion on the insulation cover for mounting the terminal plate at the inside thereof, and a locking arm extending from the insulation cover whereby the terminal receiving block can be locked or a circuit board can be locked between the locking arm and the stopping portion.

3. The kit of components for multiple purposes according to claim 1, wherein the terminal receiving block is integrally formed at a rear portion of the first insulation cover for receiving a mating terminal.

4. The kit of components for multiple purposes according to claim 1, wherein the terminal receiving block is coupled to a rear portion of the first insulation cover for receiving a mating terminal corresponding to a rear electric contact of the terminal.

5. The kit of components for multiple purposes according to claim 4, wherein the first insulation cover includes a locking device for locking the terminal receiving block.

6. The kit of components for multiple purposes according to claim 4, wherein the terminal receiving block can be connected, as a mating connector, with the front portion of the first insulation cover.

7. A kit of components for multiple purposes having a resin insulation cover for engaging with a terminal receiving block, the improvement comprising the resin insulation cover in combination with:

the terminal plate, mounted inside the resin insulation cover on locking projections, having an easy-cut insulating plate body with terminals, electric contacts of the terminals projecting from front-to-rear of the plate body; the front and rear projecting terminals being one standard type and all the same length, the terminal plate being lockable in either a harness connector or a PCB connector thereby having multi purposes, and the front and rear and left and right side halves of the terminal plate being symmetrical.

8. The kit of components for multiple purposes of claim 7, wherein the locking projections are formed of resin and attached to the inside of the insulation cover.

* * * * *